US009558692B2

(12) United States Patent
Kim et al.

(10) Patent No.: US 9,558,692 B2
(45) Date of Patent: Jan. 31, 2017

(54) ORGANIC LIGHT EMITTING DISPLAY DEVICE AND DRIVING METHOD THEREOF

(71) Applicant: SAMSUNG DISPLAY CO., LTD., Yongin, Gyeonggi-Do (KR)

(72) Inventors: Do-Ik Kim, Yongin (KR); Hak-Ki Choi, Yongin (KR)

(73) Assignee: Samsung Display Co., Ltd., Yongin-si (KR)

( * ) Notice: Subject to any disclaimer, the term of this patent is extended or adjusted under 35 U.S.C. 154(b) by 89 days.

(21) Appl. No.: 14/507,668

(22) Filed: Oct. 6, 2014

(65) Prior Publication Data

US 2015/0116302 A1 Apr. 30, 2015

(30) Foreign Application Priority Data

Oct. 28, 2013 (KR) ..... 10-2013-0128317

(51) Int. Cl.
*G09G 3/00* (2006.01)
*G09G 3/32* (2016.01)

(52) U.S. Cl.
CPC ..... *G09G 3/3208* (2013.01); *G09G 3/006* (2013.01); *G09G 3/3225* (2013.01); *G09G 2300/0852* (2013.01); *G09G 2300/0861* (2013.01); *G09G 2310/0283* (2013.01);
(Continued)

(58) Field of Classification Search
None
See application file for complete search history.

(56) References Cited

U.S. PATENT DOCUMENTS 7,474,115 B1 * 1/2009 Trujillo ..... G09G 3/006 324/762.07
9,058,773 B2 * 6/2015 Park ..... G09G 3/3233
(Continued)

FOREIGN PATENT DOCUMENTS

EP 2 637 159 A1 9/2013
KR 20-0381681 4/2005
(Continued)

OTHER PUBLICATIONS

English machine translation of Korean Unexamined Publication 10-2014-0141191 dated Dec. 10, 2014, listed above, (19 pages).
(Continued)

*Primary Examiner* — Antonio Xavier
(74) *Attorney, Agent, or Firm* — Lewis Roca Rothgerber Christie LLP

(57) ABSTRACT

An organic light emitting display device includes a display unit including pixels coupled to scan lines and data lines, first and second power lines coupled to the pixels, a DC-DC converter configured to output first and second power sources to the pixels via the first and second power lines, respectively, and a short-circuit-sensing circuit configured to detect whether a short-circuit between the first and second power lines occurs, and configured to control an operation of the DC-DC converter when the short-circuit is detected, wherein voltage levels of the first and second power sources are configured to be changed in a frame period, the frame period including a reverse voltage application period in which the voltage level of the second power source is higher than that of the first power source.

14 Claims, 4 Drawing Sheets

(52) U.S. Cl.
CPC ... *G09G 2330/021* (2013.01); *G09G 2330/08* (2013.01); *G09G 2330/12* (2013.01); *G09G 2360/08* (2013.01)

(56) References Cited

U.S. PATENT DOCUMENTS

| | | | | |
|---|---|---|---|---|
| 2010/0091001 | A1* | 4/2010 | Kim | G09G 3/3225 345/211 |
| 2011/0279484 | A1* | 11/2011 | Han | G09G 3/3233 345/690 |
| 2012/0127213 | A1* | 5/2012 | Park | G09G 3/006 345/690 |
| 2012/0182328 | A1* | 7/2012 | Yoon | G09G 5/10 345/690 |
| 2012/0256897 | A1* | 10/2012 | Seo | G09G 3/006 345/212 |
| 2013/0002639 | A1 | 1/2013 | Park | |
| 2013/0113773 | A1 | 5/2013 | Lee et al. | |
| 2013/0235016 | A1 | 9/2013 | Seo et al. | |
| 2013/0241808 | A1 | 9/2013 | Kwon et al. | |

FOREIGN PATENT DOCUMENTS

| | | |
|---|---|---|
| KR | 10-1082234 | 11/2011 |
| KR | 10-2012-0023378 | 3/2012 |
| KR | 10-2012-0114990 | 10/2012 |
| KR | 10-2013-0049049 | 5/2013 |
| KR | 10-2013-0116411 | 10/2013 |
| KR | 10-2014-0141191 | 12/2014 |

OTHER PUBLICATIONS

EPO Search Report dated Feb. 5, 2015, for corresponding European Patent application 14189348.7, (6 pages).
EPO Office action dated Jul. 28, 2016 for corresponding European Patent application 14189348.7, (9 pages).
Regan et al., "Application Note 105: Current Sense Circuit Collection Making Sense of Current," Linear Technology, Dec. 1, 2005, pp. 1-118.

* cited by examiner

ORGANIC LIGHT EMITTING DISPLAY DEVICE AND DRIVING METHOD THEREOF

CROSS-REFERENCE TO RELATED APPLICATION

This application claims priority to and the benefit of Korean Patent Application No. 10-2013-0128317, filed on Oct. 28, 2013, in the Korean Intellectual Property Office, the entire contents of which are incorporated herein by reference in their entirety.

BACKGROUND

1. Field

An aspect of an embodiment of the present invention relates to an organic light emitting display device and a driving method thereof.

2. Description of the Related Art

An organic light emitting display device, which has recently attracted the most attention among flat panel display devices, displays images using organic light emitting diodes (OLEDs) that emit light through recombination of electrons and holes.

The organic light emitting display device is a self-luminescent display device that does not require a separate backlight unit. Hence, the organic light emitting display device is advantageous in terms of power consumption, and has excellent response speed, viewing angle, and contrast ratio.

The OLED includes an anode electrode, a cathode electrode, and an organic emission layer formed therebetween. Electrons injected from the cathode electrode are coupled in the organic emission layer with holes injected from the anode electrode to form excitons. The excitons emit light while emitting energy. The organic emission layer is formed into a multi-layered structure including an emission layer (EML), an electron transport layer (ETL), and a hole transport layer (HTL) to improve emission efficiency by optimizing the balance of electrons and holes. The organic emission layer may additionally include an electron injection layer (EIL), and a hole injection layer (HIL).

SUMMARY

Embodiments of the present invention provide an organic light emitting display device and a driving method thereof, which allows the application of a driving power source to be blocked upon sensing an abnormal current generated by a short-circuit between power lines.

According to an aspect of an embodiment of the present invention, there is provided an organic light emitting display device including a display unit including pixels coupled to scan lines and data lines, first and second power lines coupled to the pixels, a DC-DC converter configured to output first and second power sources to the pixels via the first and second power lines, respectively, and a short-circuit-sensing circuit configured to detect whether a short-circuit between the first and second power lines occurs, and configured to control an operation of the DC-DC converter when the short-circuit is detected, wherein voltage levels of the first and second power sources are configured to be changed in a frame period, the frame period including a reverse voltage application period in which the voltage level of the second power source is higher than that of the first power source.

The short-circuit-sensing circuit may be configured to detect whether a reverse current is generated during a given period to detect the short-circuit, and may be configured to output a disable control signal to the DC-DC converter when the reverse current is detected.

The given period way include one or more frame periods.

The short-circuit-sensing circuit may be configured to compare an average current value of the given period with a reference value, and may be configured to detect the short-circuit, and to output the disable control signal, when the average current value is not less than the reference value.

The short-circuit-sensing circuit may be coupled to at least one of the first and second power lines.

The short-circuit-sensing circuit may include a voltage-current converter coupled to a sensing resistor of one of the first and second power lines to convert a voltage across the sensing resistor into current, and a controller configured to detect the short-circuit according to the current from the voltage-current converter.

The controller may be configured to perform sampling of the current from the voltage-current converter during a given period including n frame periods, wherein n is an integer.

The sampling may be performed at a frequency that is greater than a frequency equal to an inverse of the reverse voltage application period.

The pixels may be coupled to control signal lines and to reset signal lines.

Each pixel includes an organic light emitting diode, a driving transistor configured to control current supplied to the organic light emitting diode, and an initialization transistor coupled to an anode electrode of the organic light emitting diode, the initialization transistor being configured to be turned on, and to supply a reset voltage lower than a first power source voltage of the first power source to the anode electrode, during a partial period in one frame period.

Each pixel may further include a second capacitor including a first terminal coupled to a gate electrode of the driving transistor, a first transistor coupled between a second terminal of the second capacitor and a data line of the data lines, and configured to be turned on when a scan signal is supplied to a scan line of the scan lines, a third transistor coupled between the anode electrode of the organic light emitting diode and the gate electrode of the driving transistor, and configured to be turned on when a control signal is supplied to a control signal line of the control signal lines, and a first capacitor coupled between the second terminal of the second capacitor and the first power source.

The frame period may include a reset period, a threshold voltage compensation period, a scan period, and an emission period, and the DC-DC converter may be configured to set the first power source to a low level during the reset period, set the first power source to a high level during the threshold voltage compensation period, the scan period, and the emission period, set the second power source to the high level during the reset period, the threshold voltage compensation period, and the scan period, and set the second power source to the low level during the emission period.

According to an aspect of an embodiment of the present invention, there is provided a method of driving an organic light emitting display device, the method including applying first and second power sources from a DC-DC converter to pixels of a display unit through first and second power lines, respectively, detecting whether a short-circuit between the first and second power lines occurs, controlling the DC-DC converter based on the detecting, and changing voltage levels of the first and second power sources in a frame period, wherein the voltage level of the second power source is higher than the voltage level of the first power source during a reverse voltage application period in the frame period, and wherein the detecting includes detecting whether a reverse current is generated in the reverse voltage application period during a given period.

The given period may include one frame period or a multiple thereof.

The detecting whether the short-circuit occurs may include detecting whether an average current value during the given period is no less than a reference value.

BRIEF DESCRIPTION OF THE DRAWINGS

Example embodiments of the present invention will now be described more fully hereinafter with reference to the accompanying drawings. However, the embodiments may be embodied in different forms, and should not be construed as being strictly limited to the descriptions set forth herein. Rather, these embodiments are provided so that this disclosure will be thorough and complete, and will fully convey the scope of the example embodiments to those skilled in the art.

In the drawing figures, dimensions may be exaggerated for clarity of illustration. It will be understood that when an element is referred to as being "between" two elements, it can be the only element between the two elements, or one or more intervening elements may also be present. Like reference numerals refer to like elements throughout.

DETAILED DESCRIPTION

Figure 1:
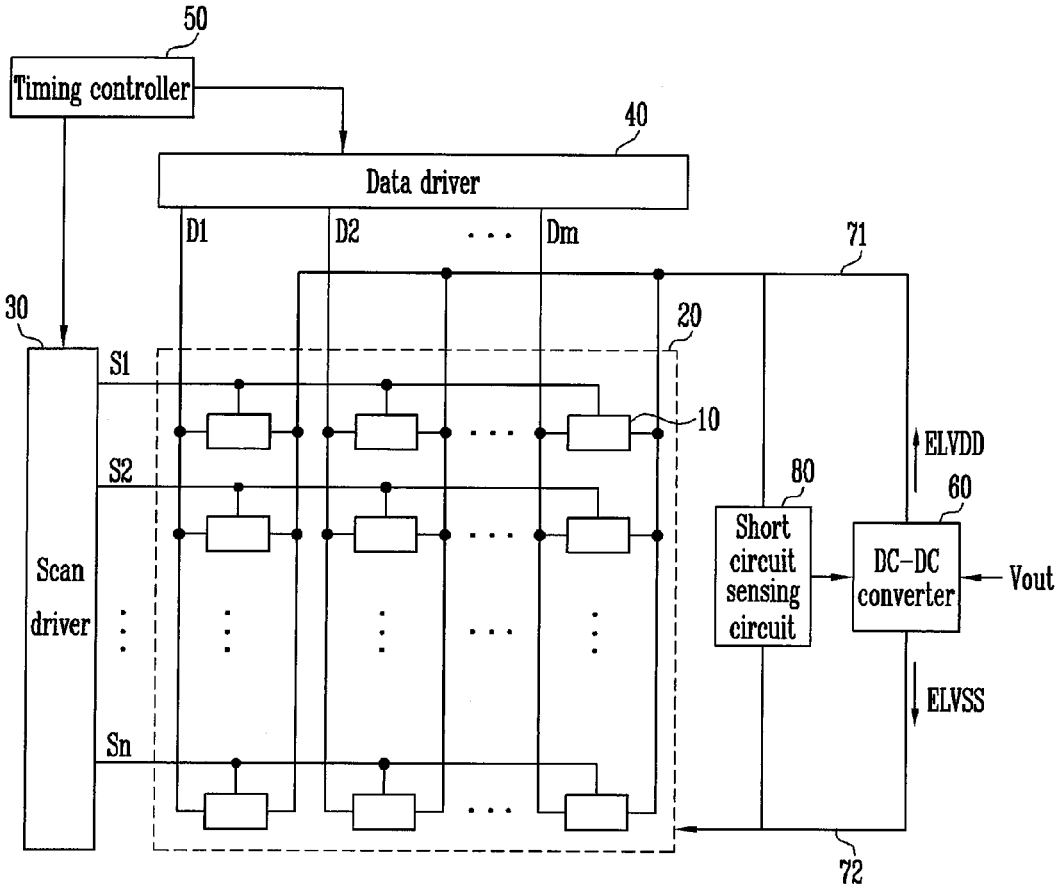
FIG. 1 is a block diagram illustrating an organic light emitting display device according to an embodiment of the present invention.

Hereinafter, certain exemplary embodiments according to the present invention will be described with reference to the accompanying drawings. Here, when a first element is described as being coupled to a second element, the first element may be directly coupled to the second element, or may be indirectly coupled to the second element via one or more other elements. Further, some of the elements that are not essential to the complete understanding of the invention are omitted for clarity. Also, like reference numerals refer to like elements throughout.

FIG. 1 is a block diagram illustrating an organic light emitting display device according to an embodiment of the present invention. Referring to FIG. 1, the organic light emitting display device according to the present embodiment includes a display unit 20 including pixels 10 respectively coupled to scan lines S1 to Sn and data lines D1 to Dm, a scan driver 30 configured to supply a scan signal to each pixel 10 through respective ones of the scan lines S1 to Sn, a data driver 40 configured to supply a data signal to each pixel 10 through respective ones of the data lines D1 to Dm, a DC-DC converter 60 configured to apply, to each pixel 10, first and second power sources ELVDD and ELVSS, which are driving power sources, and a short-circuit-sensing circuit 80 configured to sense whether a short-circuit between first and second power lines 71 and 72 occurs. The organic light emitting display device may further include a timing controller 50 configured to control the scan driver 30 and the data driver 40.

Each pixel 10 is coupled to the first and second power lines 71 and 72. Each pixel 10 receiving the first and second power sources ELVDD and ELVSS supplied from the respective power lines 71 and 72 generates light corresponding to a data signal according to current flowing from the first power source ELVDD to the second power source ELVSS via an organic light emitting diode in the respective one of the pixels 10.

That is, when an organic light emitting diode provided in a pixel 10 emits light, a forward current flows from a high-level first power source ELVDD to a low-level second power source ELVSS via the organic light emitting diode.

The scan driver 30 generates a scan signal under the control of the timing controller 50, and supplies the generated scan signal to the scan line S1 to Sn.

Although not shown in FIG. 1, the scan driver 30 may further supply, to each pixel 10, control signals and reset signals as well as the scan signal. The control signals and the reset signals may be supplied through a separate control line driving unit.

The data driver 40 generates a data signal under the control of the timing controller 50, and supplies the generated data signal to the data lines D1 to Dm.

If a scan signal is sequentially supplied to the scan lines S1 to Sn, lines or rows of pixels 10 are sequentially selected, and the selected pixels 10 receive a data signal supplied from respective ones of the data lines D1 to Dm.

The DC-DC converter 60 receives an externally supplied external power source Vout to generate the first and second power sources ELVDD and ELVSS supplied to each pixel 10 by converting the supplied external power source Vout.

In the present embodiment, each of the first and second power sources ELVDD and ELVSS generated in the DC-DC converter 60 is not a DC voltage having a set level. Instead, the voltage level of each of the first and second power sources ELVDD and ELVSS is changed in one frame period. For example, there exists a reverse voltage period in which the voltage level of the second power source ELVSS is a higher level than that of the first power source ELVDD.

During such a reverse voltage period, and assuming no short-circuit between the first and second lines occurs, the organic light emitting diode does not emit light in a normal state, and therefore, current does not flow. If a short-circuit between the first and second power lines occurs, a reverse current flows in the reverse voltage period.

The DC-DC converter 60 supplies the generated first and second power sources ELVDD and ELVSS to the display unit 20 through the respective first and second power lines 71 and 72.

Although FIG. 1 illustrates that each of the first and second power lines 71 and 72 is formed with one line, this is merely provided for convenience of illustration. That is, each of the first and second power lines 71 and 72 can be formed with a plurality of lines, and a respective first power line and a respective second power line corresponding thereto among the plurality of lines may be coupled to each pixel. However, the first and second power sources ELVDD and ELVSS, which are power sources applied to the plurality of first power lines and the plurality of second power lines, are equally applied to the first and second power lines, respectively.

That is, first and second power lines corresponding to each pixel 10 are coupled to the pixel 10, and the same first and second power sources are applied to all the pixels. However, the same power line is not coupled to each pixel. That is, different ones of the first power lines and different ones of the second power lines are coupled to different ones of the pixels.

The first and second power sources ELVDD and ELVSS are not output to each of the first power lines 71 and 72 during a disable state in which the DC-DC converter 60 is not operated.

The operation of the DC-DC converter 60 is controlled by a control signal (e.g., a disable control signal) output from the short-circuit-sensing circuit 80, which detects whether a short-circuit between the first and second power lines occurs.

For example, the short-circuit-sensing circuit 80 detects the average value of current flowing in the display unit 20 during a given period (e.g., one frame period), and/or detects whether a reverse current is generated in the reverse voltage period. If the short-circuit-sensing circuit detects that the first and second power lines have been short-circuited to each other, based on the detected result, the short-circuit-sensing circuit 80 outputs a control signal (e.g., a disable control signal) to the DC-DC converter 60, thereby stopping the operation of the DC-DC converter 60.

A pixel 10 having a reverse voltage applied thereto during the reverse voltage period, and a driving method thereof will be described in FIGS. 2 and 3. However, this is merely one embodiment, and the present invention is not limited thereto.

Figure 2:
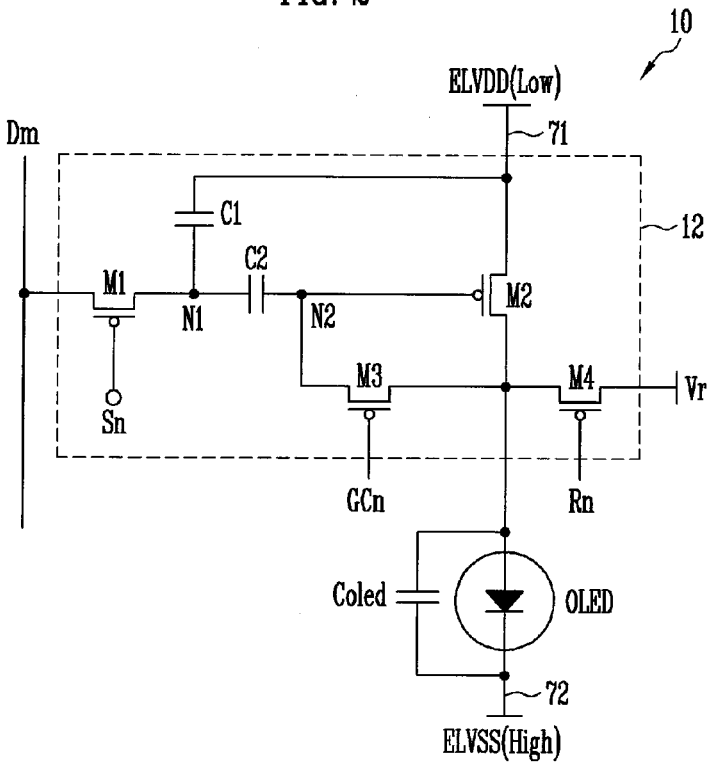
FIG. 2 is a circuit diagram illustrating an embodiment of a pixel shown in FIG. 1.

FIG. 2 is a circuit diagram illustrating an embodiment of the pixel shown in FIG. 1. FIG. 3 is a waveform diagram illustrating a driving method of the pixel shown in FIG. 2.

Referring to FIG. 2, the pixel 10 according to the present embodiment includes an organic light emitting diode OLED, and a pixel circuit 12 configured to control the amount of current supplied to the organic light emitting diode OLED.

An anode electrode of the organic light emitting diode OLED is coupled to the pixel circuit 12, and a cathode electrode of the organic light emitting diode OLED is coupled to the second power line 72 to which the second power source ELVSS is applied. The organic light emitting diode OLED generates light with a luminance corresponding to current supplied from the pixel circuit 12.

The pixel circuit 12 charges a voltage corresponding to a data signal and to the threshold voltage of a driving transistor, and controls the amount of current supplied to the organic light emitting diode OLED according to the charged voltage. To this end, the pixel circuit 12 includes four transistors M1 to M4 and two capacitors C1 and C2.

A gate electrode of a first transistor M1 is coupled to a scan line Sn, and a first electrode of the first transistor M1 is coupled to a data line Dm. A second electrode of the first transistor M1 is coupled to a first node N1. The first transistor M1 is turned on when a scan signal is supplied to the scan line Sn, to thereby allow the data line Dm and the first node N1 to be electrically coupled to each other.

A gate electrode of a second transistor (driving transistor) M2 is coupled to a second node N2, and a first electrode of the second transistor M2 is coupled to the first power line 71 to which the first power source ELVDD is applied. A second electrode of the second transistor M2 is coupled to the anode electrode of the organic light emitting diode OLED. The second transistor M2 controls the amount of current supplied to the organic light emitting diode OLED according to a voltage applied to the second node N2.

A first electrode of a third transistor M3 is coupled to the second electrode of the second transistor M2, and a second electrode of the third transistor M3 is coupled to the second node N2. A gate electrode of the third transistor M3 is coupled to a control line GCn. The third transistor M3 is turned on when a control signal is supplied to the control line GCn, to thereby allow the second transistor M2 to be diode-coupled.

A first electrode of a fourth transistor M4 is coupled to the anode electrode of the organic light emitting diode OLED, and a second electrode of the fourth transistor M4 is coupled to a reset power source Vr. A gate electrode of the fourth transistor M4 is coupled to a reset line Rn. The fourth transistor M4 is turned on when a reset signal is supplied to the reset line Rn, to thereby supply the voltage of the reset power source Vr to the anode electrode of the organic light emitting diode OLED.

A first capacitor C1 is coupled between the first node N1 and the first power line 71, and charges a voltage corresponding to the data signal.

A second capacitor C2 is coupled between the first and second nodes N1 and N2, and charges a voltage corresponding to the threshold voltage of the second transistor M2.

A driving method of the pixel will be described with reference to FIGS. 2 and 3.

The first power source ELVDD is set to a low level during a reset period, and is set to a high level during a threshold voltage compensation period, a scan period and an emission period. The second power source ELVSS is set to the high level during the reset period, the threshold voltage compensation period and the scan period, and is set to the low level during the emission period. Here, the pixel 10 emits light only during a period in which the first power source ELVDD is set to the high level and the second power source ELVSS is set to the low level (i.e., the emission period).

Figure 3:
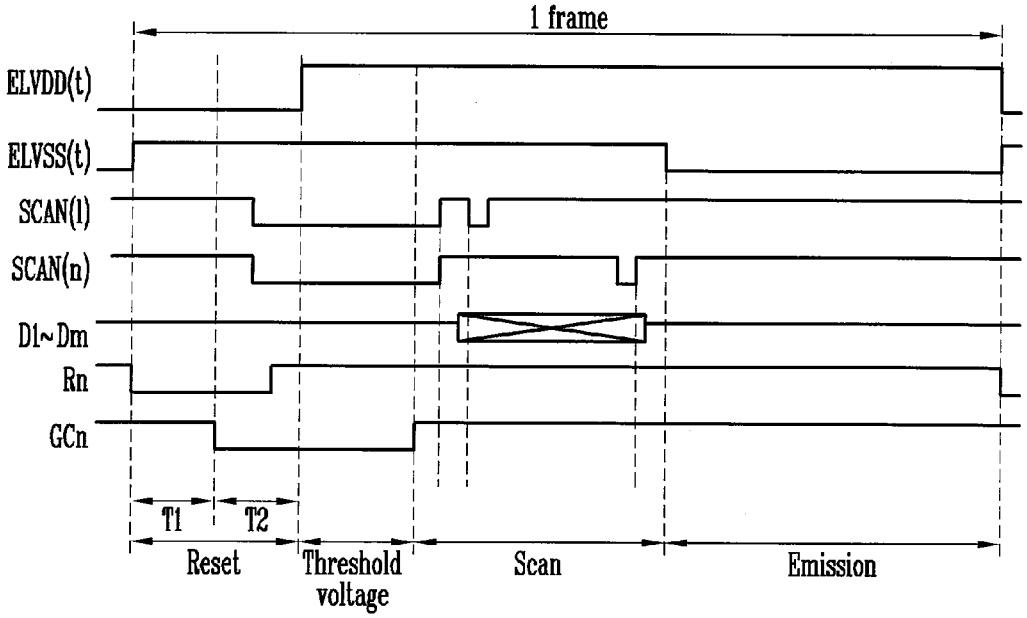
FIG. 3 is a waveform diagram illustrating a driving method of the pixel shown in FIG. 2.

Referring to FIG. 3, a reset signal is first supplied to the reset line Rn to cause the fourth transistor M4 to be turned on. If the fourth transistor M4 is turned on, the voltage of the reset power source Vr is supplied to the anode electrode of the organic light emitting diode OLED. That is, the anode electrode of the organic light emitting diode OLED is initialized to the voltage of the reset power source Vr during a first period T1 in the reset period.

A control signal is supplied to the control line GCn during a second period T2 of the reset period, thereby causing the third transistor M3 to be turned on. If the third transistor M3 is turned on, the voltage of the reset power source Vr is supplied to the second node N2. That is, the second node N2 and the anode electrode of the organic light emitting diode OLED are initialized to the voltage of the reset power source Vr during the reset period.

In the threshold voltage compensation period following the reset period, the supply of the control signal to the control line GCn is maintained so that the third transistor M3 remains turned on. During the threshold voltage compensation period, the supply of the reset signal to the reset line Rn is stopped so that the fourth transistor M4 is turned off.

If the third transistor M3 is turned on, the second transistor M2 is diode-coupled, causing the voltage of the second node N2 to be initialized to the voltage of the reset power source Vr, and hence the second transistor M2 is turned on. If the second transistor M2 is turned on, the voltage of the second node N2 rises up to the voltage obtained by subtracting the absolute threshold voltage of the second transistor M2 from the voltage of the high-level first power source ELVDD. After the voltage of the second node N2 rises to the voltage obtained by subtracting the absolute threshold voltage of the second transistor M2 from the voltage of the first power source ELVDD, the second transistor M2 is turned off.

Meanwhile, a scan signal is supplied to the scan line Sn during the threshold voltage compensation period. If the scan signal is supplied to the scan line Sn, the first transistor M1 is turned on. If the first transistor M1 is turned on, the data line Dm and the first node N1 are electrically coupled to each other, and a voltage is supplied to the data lines D1 to Dm. the voltage being within the voltage range of a plurality of data signals (e.g., a voltage higher than an intermediate gray-scale data signal).

During the threshold voltage compensation period, the second capacitor C2 charges a voltage between the first and second nodes N1 and N2 (i.e., a voltage corresponding to the threshold voltage of the second transistor M2). In other words, the voltage supplied to the first node N1 is set equally in all the pixels 10, but the voltage supplied to the second node N2 is set differently for each pixel 10 according to the threshold voltage of the second transistor M2. Thus, the voltage charged in the second capacitor C2 corresponds to the threshold voltage of the second transistor M2, and accordingly, it is possible to compensate for a variation in the threshold voltage of the second transistor M2.

Subsequently, a scan signal is sequentially applied to the scan lines S1 to Sn, and a data signal is supplied to the data lines D1 to Dm to be synchronized with the scan signal. If the scan signal is supplied to the scan line Sn, the first transistor M1 is turned on. If the first transistor M1 is turned on, a data signal from the data line Dm is supplied to the first node N1. In this case, the first capacitor C1 charges a voltage corresponding to the data signal. Meanwhile, the second node N2 is set to a floating state during the scan period, and accordingly, the second capacitor C2 maintains a voltage charged in a previous period, regardless of a change in the voltage of the first node N1.

The low-level second power source ELVSS is supplied during the emission period following the scan period. In this case, the second transistor M2 controls the amount of current flowing to the organic light emitting diode OLED, the current corresponding to voltages charged in the first and second capacitors C1 and C2. Thus, an image with a luminance corresponding to the data signal is displayed in the display unit 20 during the emission period.

However, according to the waveform diagram shown in FIG. 3, there exists a reverse voltage period in which the first power source ELVDD is set to the low level and the second power source ELVSS is set to the high level during the reset period.

As described above, during such a reverse voltage period, the reverse voltage period is not a period in which the organic light emitting diode emits light in a normal state in which any short-circuit between the first and second lines does not occur, and therefore, current does not flow. If a short-circuit between the first and second power lines occurs, a reverse current flows in the reverse voltage period.

Accordingly, the short-circuit-sensing circuit 80 decides whether a short-circuit between the first and second power lines occurs by detecting whether a reverse current is generated in the reverse voltage period, and controls the operation of the DC-DC converter 60 based on the decided result.

Figure 4:
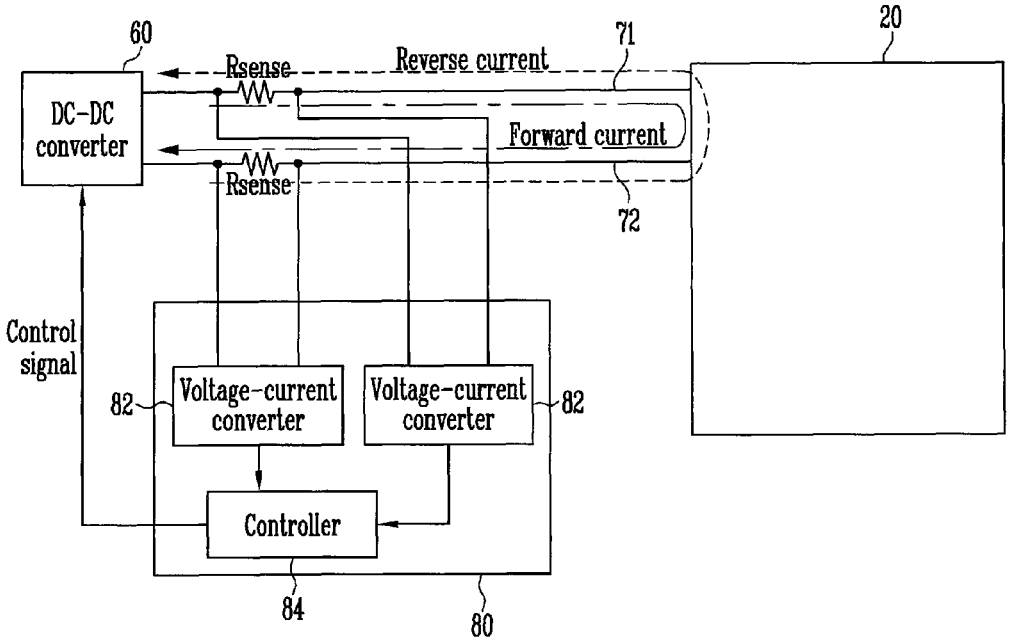
FIG. 4 is a block diagram illustrating a short-circuit-sensing circuit according to an embodiment of the present invention.
Figure 5:
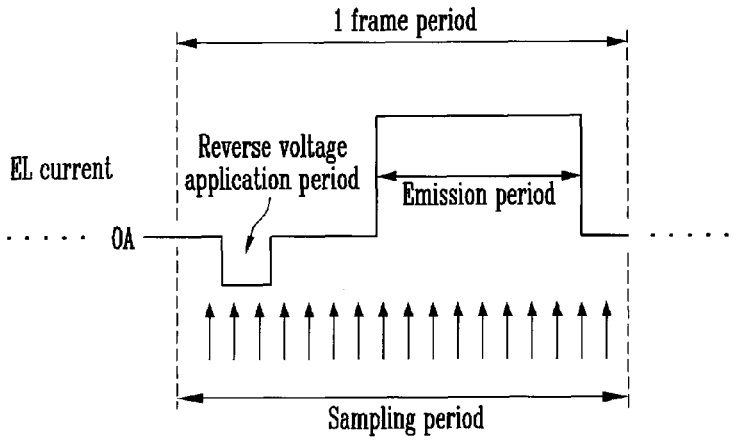
FIG. 5 is a diagram illustrating a method of sensing a short-circuit between power lines.

FIG. 4 is a block diagram illustrating a short-circuit-sensing circuit according to an embodiment of the present invention. FIG. 5 is a diagram illustrating a method of sensing a short-circuit between power lines.

Referring to FIG. 4, the short-circuit-sensing circuit 80 according to the present embodiment is coupled to the first and second power lines 71 and 72, which are coupled between the DC-DC converter 60 and a display panel (i.e., the display unit 20), to perform a function of sensing whether a short-circuit between the first and second power lines 71 and 72 occurs.

To this end, the short-circuit-sensing circuit 80, as shown in FIG. 4, includes a voltage-current converter 82 coupled to a sensing resistor Rsense formed in each of the first and second power lines 71 and 72 to convert a voltage generated in the sensing resistor into current, and a controller 84 configured to decide whether a short-circuit between the first and second power lines 71 and 72 occurs by receiving the current output from the voltage-current converter 82.

In the present embodiment, the voltage generated in the sensing resistor Rsense may be amplified to an extent where the voltage can be decided through an amplifier.

In the embodiment shown in FIG. 4, a sensing resistor Rsense is formed in each of the first power line 71 and the second power line 72 corresponding thereto, and the voltage-current converter 82 is provided to be coupled to each sensing resistor Rsense. However, this is provided to perform a more exact detection. That is, the occurrence of a short-circuit between the first and second power lines may be decided by forming a sensing resistor in at least one of the first and second power lines, and by detecting a voltage of the sensing resistor formed in the at least one power line.

In the present embodiment, the first and second power lines 71 and 72 are indicated as one line each, but this is provided for convenience of illustration. That is, each of the first and second power lines 71 and 72 is formed with a plurality of lines. However, the first and second power sources ELVDD and ELVSS, which are power sources applied to the plurality of first power lines and the plurality of second power lines, are equally applied to the first power lines and the second power lines, respectively.

In the embodiment shown in FIG. 4, first and second power lines corresponding to a given pixel 10 from among the pixels in the display unit 20 is described as an example. In a normal operation state, a forward current flows from the first power line to the second power line via the pixel 10 of the display unit 20.

As described through FIGS. 2 and 3, in the pixel according to the present embodiment, there exists a reverse voltage period in which the first power source ELVDD is set to the low level, and the second power source ELVSS is set to the high level in a given period (i.e., the reset period). Accordingly, if there occurs a short-circuit between the first and second power lines to which the first and second power sources are applied, a reverse current flows in the reverse voltage period.

That is, in the short-circuit state, a reverse current flows from the second power source to the first power source via the pixel 10 of the display unit 20.

The short-circuit-sensing circuit 80 according to the present embodiment detects whether a reverse current is generated in the reverse voltage period during a given period (e.g., one frame period). If it is decided that the first and second power lines have been short-circuited to each other, based on the detected result, the short-circuit -sensing circuit 80 outputs a control signal to the DC-DC converter 60, thereby stopping the operation of the DC-DC converter 60.

In addition, the short-circuit-sensing circuit 80 obtains an average current value during the emission period of the pixel even though a forward current flows. In a case where the average current value is no less than a reference value, as determined by comparing the average current value with the reference value, the short-circuit-sensing circuit 80 may decide that the first and second power lines have been short-circuited to each other.

FIG. 5 is a diagram illustrating detection of current when a short-circuit occurs between first and second power lines coupled to a given pixel of the pixels 10. As shown in this figure, a reverse current having a negative level is generated in a period (corresponding to the reset period of FIG. 3) where a reverse voltage is applied, and the average value of current (forward current) in the emission period is no less than the reference value.

The short-circuit-sensing circuit 80 according to the present embodiment, senses current during a period including one frame period or more (i.e., a period including one or more frame periods, such as a period including two frame periods, three frame periods, etc.).

For example, the short-circuit-sensing circuit 80 samples an analog current value input using an analog-digital converter provided in the controller 84.

That is, the occurrence of a short-circuit between the first and second power lines may be detected by performing the sampling during one frame period. However, to perform a more exact detection, the sampling is preferably performed during a period longer than the one frame period.

In this case, the sampling frequency is greater than a reciprocal, or inverse, of the period in which the reverse voltage is applied. Accordingly, it is possible to detect whether the reverse current is applied in the period where the reverse voltage is applied in the at least one frame period.

Thus, if it is decided that the first and second power lines have been short-circuited to each other by detecting the reverse current in the reverse voltage application period, the short-circuit-sensing circuit 80 outputs a control signal to the DC-DC converter 60, thereby stopping the operation of the DC-DC converter 60.

In a case where the average current value is no less than a reference value, as determined by comparing the average current value with the reference value, the short-circuit-sensing circuit 80 may decide that the first and second power lines have been short-circuited to each other (e.g., a relatively high amount of current may indicate a short-circuit). The short-circuit-sensing circuit 80 outputs the same control signal to the DC-DC converter 60, thereby stopping the operation of the DC-DC converter 60.

For example, when light of full white is emitted, the average value of current flowing in the emission period is set to a reference value, and a data signal corresponding to the emission of the light of full white is applied as a test signal, thereby comparing the average current value in the emission period with the reference value.

The short-circuit-sensing circuit 80 according to the present embodiment can decide whether a short-circuit between the first and second power lines occurs by detecting current from each of the first and second power lines as shown in FIG. 4. Accordingly, it is possible to perform a more exact detection.

Figure 6:
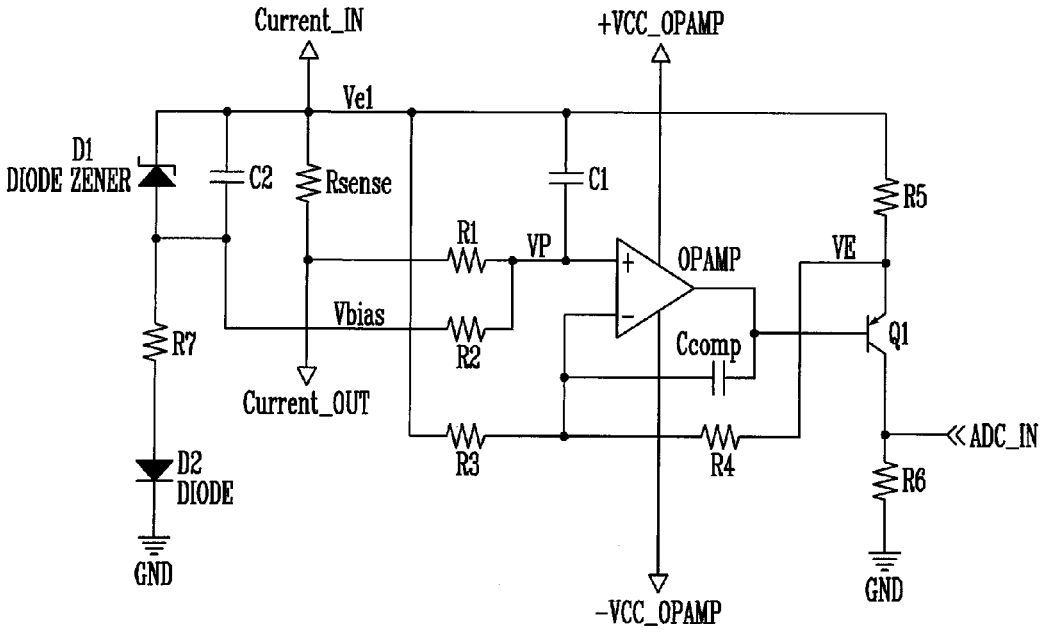
FIG. 6 is a circuit diagram illustrating an embodiment of a partial configuration of the short-circuit-sensing circuit shown in FIG. 4.

FIG. 6 is a circuit diagram illustrating an embodiment of a partial configuration of the short-circuit-sensing circuit shown in FIG. 4.

The embodiment shown in FIG. 6 relates to the configuration of a circuit for a portion including the voltage-current converter 82 in the short-circuit-sensing circuit 80. However, this is merely an embodiment, and the configuration of the short-circuit-sensing circuit of the present invention is not limited thereto.

Referring to FIG. 6, the circuit performs an operation of converting a voltage in proportion to current flowing in the first or second power line with respect to a ground voltage GND, and applying the converted voltage as an input of the analog-digital converter.

The current may flow in a forward or reverse direction, as described above. Accordingly, a reference voltage Vbias is supplied using a Zener diode D1 (or reference voltage source) to sense current flowing in both directions.

Current (hereinafter, referred to as EL current) flowing through the organic light emitting diode of a given pixel flows through a sensing resistor Rsense formed in the power line, and a voltage drop (IR-drop) occurs at both ends of the resistor Rsense. That is, when the EL current is equal to le, a voltage equal to le*Rsense is generated at both ends of the sensing resistor Rsense.

The voltage VP of a non-inverting input of an OP AMP, which is an amplifier, becomes VP=Vel−(le*Rsense*(R2/(R2+R1))+Vbias*(R1/(R1+R2))), and the amplified voltage VE becomes VE=Vel−VP*(R3+R4)/R3=Vel−(le*Rsense*(R2/(R2+R1)*(R3+R4)/R3+Vbias*(R1/(R1+R2))*(R3+R4)/R3).

In the present embodiment, Vel is a voltage corresponding to the EL current.

If it is assumed that R2/R1=R4/R3=G, then VE=le*Rsense*G+Vbias, and current in proportion to the EL current flows through R5.

When the EL current is 0, current equal to Vbias/R5 flows through R5.

In a case where the EL current becomes reverse current due to the short-circuit between the first and second power lines, current lower than that of Vbias/R5 flows through R5, and accordingly, it is possible to detect the EL current in both directions.

Although the voltage of the first power source (+ELVDD_IN) is changed, the collector current output of a transistor Q1 is not changed. Thus, the circuit is not influenced by a change in the voltage of the power source. The transistor Q1 is operated as a current output, and a voltage across R6 is converted into a voltage with respect to GND. The converted voltage is applied to an input of ADC (ADC_IN).

When the EL current is detected in the first power line, the voltage of the OP AMP+VCC_OPAMP will be higher than that of the first power source ELVDD. When the EL current is detected in the second power line, the voltage of −VEE_OPAMP will be lower than that of the second power source ELVSS. That is, the voltage at the sensing resistance Rsense will be in a range between +VCC_OPAMP and −VEE_OPAMP.

Although it has been illustrated that the transistor is a BJT transistor, the present invention is not limited thereto. That is, the transistor may be a MOSFET.

As a modified embodiment, the OP AMP may be used as a differential amplifier by removing the transistor.

By way of summation and review, the organic light emitting diode is driven using driving power sources ELVDD and ELVSS together with a pixel voltage according to an image signal. Thus, the display panel includes power lines, to which the power sources are applied, the organic light emitting diode, and a plurality of pixels coupled to the power lines and formed in the display panel.

However, the power lines may be short-circuited to each other due to errors in fabrication of the display panel, or errors or deterioration in the use of the display panel. When the power lines are short-circuited, overcurrent is generated between the display panel and a power supply unit for supplying the driving power sources, and the organic light emitting diode may be burnt or damaged due to the overcurrent. Therefore, the display panel may be damaged.

In the organic light emitting display device and the driving method thereof according to embodiments of the present invention, the application of a driving power source is blocked when an abnormal current generated by a short-circuit between power lines is sensed, making it possible to prevent the display panel from being damaged due to the burning of the organic light emitting diode that would be otherwise caused by overcurrent between the power supply unit and the display panel.

Example embodiments of the present invention have been disclosed herein, and although specific terms are employed, they are used and are to be interpreted in a generic and descriptive sense only, and are not to be used for purpose of limitation. In some instances, as would be apparent to one of ordinary skill in the art as of the filing of the present application, features, characteristics, and/or elements described in connection with a particular embodiment may be used singly or in combination with features, characteristics, and/or elements described in connection with other embodiments, unless otherwise specifically indicated. Accordingly, it will be understood by those of skill in the art that various changes in form and details may be made without departing from the spirit and scope of the present invention as set forth in the following claims and their equivalents.

What is claimed is:

1. An organic light emitting display device comprising:

a display unit comprising pixels coupled to scan fines and data lines;

first and second power lines coupled to the pixels;

a DC-DC converter configured to output first and second power sources to the pixels via the first and second power lines, respectively; and a short-circuit-sensing circuit configured to detect whether a short-circuit between the first and second power lines occurs, and configured to control an operation of the DC-DC converter when the short-circuit is detected, wherein voltage levels of the first and second power sources are configured to be changed in a frame period, the frame period comprising a reverse voltage application period in which the voltage level of the second power source is higher than that of the first power source, and wherein the short-circuit-sensing circuit is configured to detect whether a reverse current is generated during a given period to detect the short-circuit, and is configured to output a disable control signal to the DC-DC converter when the reverse current is detected.

2. The organic light emitting display device of claim 1, wherein the given period comprises one or more frame periods.

3. The organic light emitting display device of claim 1, wherein the short-circuit-sensing circuit is configured to compare an average current value of the given period with a reference value, and is configured to detect the short-circuit, and to output the disable control signal, when the average current value is greater than or equal to the reference value.

4. The organic light emitting display device of claim 1, wherein the short-circuit-sensing circuit is coupled to at least one of the first and second power lines.

5. The organic light emitting display device of claim 1, wherein the pixels are coupled to control signal lines and to reset signal lines.

6. The organic light emitting display device of claim 5, wherein each pixel comprises:

an organic light emitting diode;

a driving transistor configured to control current supplied to the organic light emitting diode; and an initialization transistor coupled to an anode electrode of the organic light emitting diode, the initialization transistor being configured to be turned on, and to supply a reset voltage lower than a first power source voltage of the first power source to the anode electrode, during a partial period in one frame period.

7. The organic light emitting display device of claim 6, wherein each pixel further comprises:

a second capacitor comprising a first terminal coupled to a gate electrode of the driving transistor;

a first transistor coupled between a second terminal of the second capacitor and a data line of the data lines, and configured to be turned on when a scan signal is supplied to a scan line of the scan lines;

a third transistor coupled between the anode electrode of the organic light emitting diode and the gate electrode of the driving transistor, and configured to be turned on when a control signal is supplied to a control signal line of the control signal lines; and a first capacitor coupled between the second terminal of the second capacitor and the first power source.

8. The organic light emitting display device of claim 1, wherein the frame period comprises a reset period, a threshold voltage compensation period, a scan period, and an emission period, and wherein the DC-DC converter is configured to:

set the first power source to a low level during the reset period;

set the first power source to a high level during the threshold voltage compensation period, the scan period, and the emission period;

set the second power source to the high level during the reset period, the threshold voltage compensation period, and the scan period; and set the second power source to the low level during the emission period.

9. An organic light emitting display device comprising:

a display unit comprising pixels coupled to scan lines and data lines;

first and second power lines coupled to the pixels;

a DC-DC converter configured to output first and second power sources to the pixels via the first and second power lines, respectively; and a short-circuit-sensing circuit configured to detect whether a short-circuit between the first and second power lines occurs, and configured to control an operation of the DC-DC converter when the short-circuit is detected, wherein voltage levels of the first and second power sources are configured to be changed in a frame period, the frame period comprising a reverse voltage application period in which the voltage level of the second power source is higher than that of the first power source, and wherein the short-circuit-sensing circuit comprises:

a voltage-current converter coupled to a sensing resistor of one of the first and second power lines to convert a voltage across the sensing resistor into current; and a controller configured to detect the short-circuit according to the current from the voltage-current converter.

10. The organic light emitting display device of claim 9, wherein the controller is configured to perform sampling of the current from the voltage-current converter during a given period comprising n frame periods, wherein n is an integer.

11. The organic light emitting display device of claim 10, wherein the sampling is performed at a frequency that is greater than a frequency equal to an inverse of the reverse voltage application period.

12. A method of driving an organic light emitting display device, the method comprising:

applying first and second power sources from a DC-DC converter to pixels of a display unit through first and second power lines, respectively;

detecting whether a short-circuit between the first and second power lines occurs;

controlling the DC-DC converter based on the detecting; and changing voltage levels of the first and second power sources in a frame period, wherein the voltage level of the second power source is higher than the voltage level of the first power source during a reverse voltage application period in the frame period, and wherein the detecting comprises detecting whether a reverse current is generated in the reverse voltage application period during a given period.

13. The method of claim 12, wherein the given period comprises one frame period or a multiple thereof.

14. The method of claim 13, wherein the detecting whether the short-circuit occurs comprises detecting whether an average current value during the given period is greater than or equal to a reference value.

* * * * *